US010494886B2

(12) United States Patent
Xu et al.

(10) Patent No.: US 10,494,886 B2
(45) Date of Patent: Dec. 3, 2019

(54) POTENTIAL ENERGY ACTUATED VALVE TRIGGERED BY COLLAPSE OF A SUPPORT MEMBER

(71) Applicant: Baker Hughes, a GE company, LLC, Houston, TX (US)

(72) Inventors: YingQing Xu, Tomball, TX (US); Kent S. Meyer, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 260 days.

(21) Appl. No.: 15/641,874

(22) Filed: Jul. 5, 2017

(65) Prior Publication Data

US 2019/0010773 A1 Jan. 10, 2019

(51) Int. Cl.
*E21B 34/06* (2006.01)
*E21B 23/04* (2006.01)

(52) U.S. Cl.
CPC ..... *E21B 23/04* (2013.01); *E21B 34/066* (2013.01)

(58) Field of Classification Search
CPC ..... E21B 34/06; E21B 34/066
See application file for complete search history.

(56) References Cited

U.S. PATENT DOCUMENTS 5,188,183 A * 2/1993 Hopmann ..... E21B 33/12 166/299
6,382,234 B1 5/2002 Birckhead et al.
8,235,103 B2 * 8/2012 Wright ..... E21B 41/00 166/316
9,022,440 B2 5/2015 Guidry et al.
9,428,997 B2 8/2016 Broussard et al.
9,593,546 B2 * 3/2017 Wright ..... E21B 23/04

OTHER PUBLICATIONS

Baker Hughes Completions and Production, Workover Systems, Compression Set Service Packers, Setting Tools, Stinger Subs, and Wireline, E-4 Wireline Pressure Setting Assembly, Dec. 2012, 1, 66-67.

* cited by examiner

*Primary Examiner* — Catherine Loikith
(74) *Attorney, Agent, or Firm* — Shawn Hunter

(57) ABSTRACT

A valve device selectively communicates annulus pressure or pressure from a hydraulic circuit to an actuation piston of a borehole tool to directly or indirectly set the borehole tool. A valve member is held against spring bias by a retainer whose physical properties can be remotely changed to release the force of the bias to move the valve member which in turn moves an actuating piston to set the borehole tool. The compressive strength of the material can be impacted by electric current that directly or indirectly such as with the generation of heat results in weakening the retainer. The retainer material may be surrounded with a sleeve to enhance compressive strength until the remote signal is applied such as with wireline or electric line. Other property changes to the retainer are contemplated such as volume change, shape change, change in state or change in tensile or compressive strength.

3 Claims, 2 Drawing Sheets

POTENTIAL ENERGY ACTUATED VALVE TRIGGERED BY COLLAPSE OF A SUPPORT MEMBER

FIELD OF THE INVENTION

The field of the invention is trigger valves for operation of borehole tools and more particularly tools that set hydrostatically or hydraulically with potential energy moving a valve member where such movement is enabled with structural retainer failure.

BACKGROUND OF THE INVENTION

Some borehole tools employ available hydrostatic pressure at a desired location to selectively set with a remote signal. Typically, a valve member allows hydrostatic pressure to be communicated with one side of a piston where the opposite side is exposed to a far lower pressure so that the pressure imbalance results in a net force that moves the piston where the movement of the piston results in actuation of the tool directly or indirectly.

FIG. 1 shows such a valve that has a housing 1 that holds a valve member 6 that has seals 7 and 8 on one side of passage 20 and seals 9 and 10 on the other side of passage 20. When valve member 6 moves left to open passage 20 the annulus 24 pressure communicates to an actuating piston 16 to set a borehole tool that is not shown. Valve member 6 is biased to the left by spring 11. Valve member 6 is connected to extension 52 by a connecting rod 53. A segmented retainer 5 has its segments held by a peripheral band that is not shown whose ends are retained to each other with a link that is failed by electric current from line 26 causing heat that leads to the failure of the link. When failure occurs the segments are displaced radially so that they are no longer in position to impede movement to the left by extension 52. The spring 11 is able to push the extension 52 and the valve member 6 to the left bringing seals 9 and 10 past the passage 20 for moving a setting piston 16 to set the borehole tool that is not shown with pressure in annulus 24 or alternatively pressure from a connected hydraulic circuit.

While this design has worked in the past it has potential operability issues in that once the fuse is melted and the segments are free to move they may not move cleanly in a radial direction and out of the way of the moving valve member 6. These segments may cock or jam preventing seals 9 and 10 from travel past passage 20 so that setting piston 16 may never trigger due to inability of hydrostatic pressure in annulus 24 or a connected hydraulic circuit to pass through passage 20. The current design with segments held by a garter spring itself held in position with a link that melts from heat provided by electric current is also expensive to produce apart from the reliability issue discussed above.

Devices that release potential energy to set a tool are illustrated in U.S. Pat. Nos. 9,022,440 and 9,428,977.

The present invention addresses these shortcomings of the prior design by providing a material that changes physical properties from a supporting position against bias on the valve member to a reconfigured position where a physical property has changed such that resistance to movement of a valve member is sufficiently decreased to allow the valve member to move to open the passage to the annulus or to a hydraulic pressure source to move an actuating piston on a borehole tool to actuate the borehole tool directly or indirectly. The change in physical property can be accomplished with electric power delivered on wireline or electric line.

These and other features of the present invention may be more readily understood from a review of the description of the preferred embodiment and the associated drawings while recognizing that the full scope of the invention is to be determined from the appended claims.

SUMMARY OF THE INVENTION

A valve device selectively communicates annulus pressure or pressure from a hydraulic circuit to an actuation piston of a borehole tool to directly or indirectly set the borehole tool. A valve member is held against spring bias by a retainer whose physical properties can be remotely changed to release the force of the bias to move the valve member which in turn moves an actuating piston to set the borehole tool. The compressive strength of the material can be impacted by electric current that directly or indirectly such as with the generation of heat results in weakening the retainer. The retainer material may be surrounded with a sleeve to enhance compressive strength until the remote signal is applied such as with wireline or electric line. Other property changes to the retainer are contemplated such as volume change, shape change, change in state or change in tensile or compressive strength.

DETAILED DESCRIPTION OF THE PREFERRED EMBODIMENT

Figure 1:
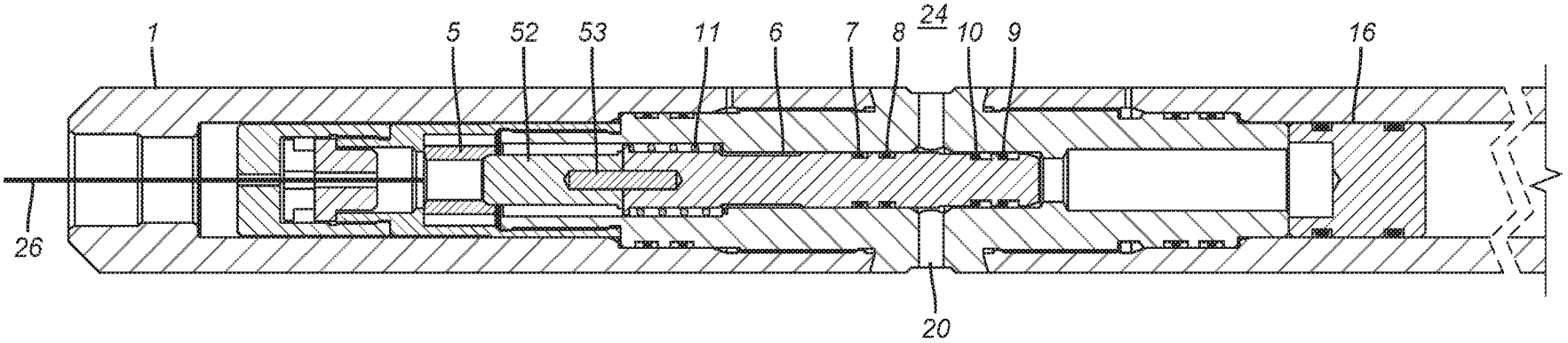
(PRIOR ART) FIG. 1
FIG. 1 is a section view of a current design of a segmented retainer where the segments are released from each other to allow a valve member to open a port to actuate a borehole tool.
Figure 2:
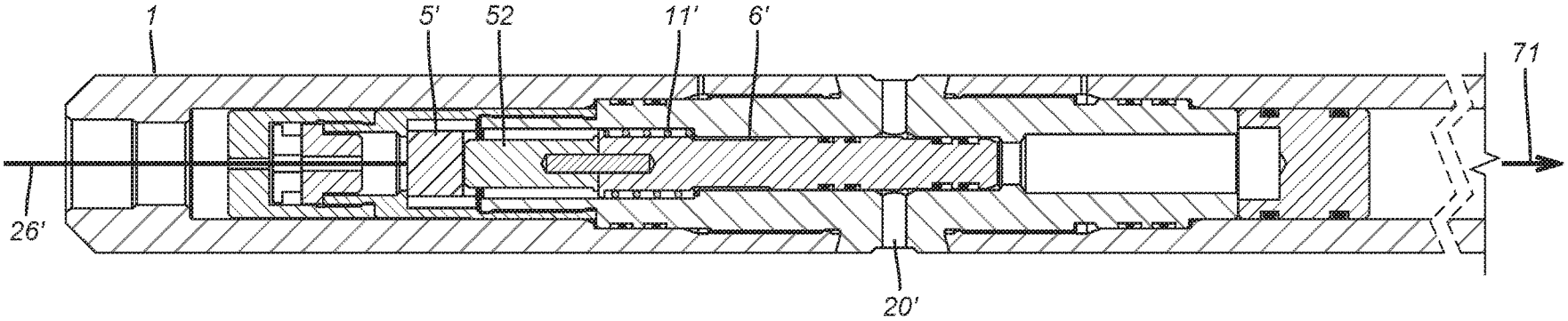
FIG. 2 is a section view showing a retainer altered remotely such that potential energy can move a valve member to operate an actuation piston of a borehole tool.

FIG. 2 differs from FIG. 1 mainly in the configuration of item 5'. Item 5' acts as a retainer against the force of spring 11'. Application of electric power through wireline or electric line 26' starts disintegration of retainer 5' that can start out a cylinder formed with compressed granular or powdered material which could optionally have some binder in it. The application of power or the creation of heat can either break down the binder or alter the molecular structure to the point where compressive strength is reduced or eliminated. This lets the spring 11' push the valve member 6' to the left to open passage 20'. The disintegrating material can be a controlled electrolytic material (CEM) or Thermite or other materials that lose compressive strength or change shape with electric power input directly or indirectly in the form of heat.

Figure 6:
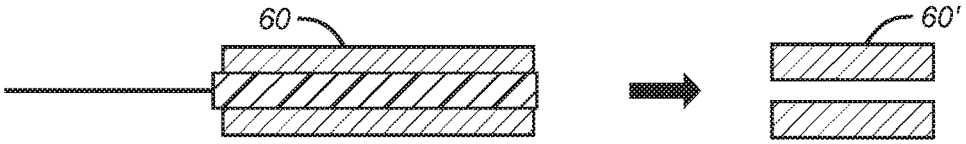
FIG. 6 uses shape change of shape memory material to allow the valve member to move.

For example, retainer 5' can be a shape memory material 60, as in FIG. 6, that when heated to above its critical temperature shortens axially 60' sufficiently to let spring 11' push the valve member 6' to open passage 20'. The shape memory material can have room to enlarge radially as it shrinks axially to allow valve member 6' to move axially to open passage 20'.

In a different embodiment the retainer 5' can undergo a change of state and flow through an opening to allow the valve member 6' to move to open passage 20'. For example the material can be brought above its melting point with added heat from line 26' which can be connected to a heater for that purpose. The wax could have compressive strength to resist the force from spring 11' until melted and flowed through a passage into a reservoir thus allowing spring 11' to move valve member 6' away from passage 20' to set the borehole tool that is not shown.

Figure 7:
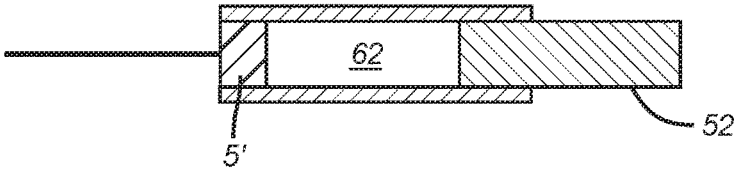
FIG. 7 allows incompressible fluid displacement to allow the valve member to move.
Figure 8:
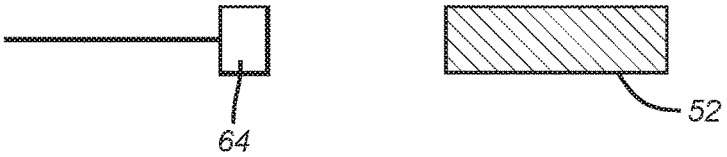
FIG. 8 uses a motor translating a screw to move the valve member and associated extension.

In another embodiment, the restraint can be an incompressible liquid that is retained against escape to provide the needed resistance to spring 11' until a remote signal opens a port to let the fluid escape into an adjacent low pressure chamber filled with a compressible fluid. FIG. 7 shows trapped incompressible fluid 62 that is released after retainer 5' disintegrates. In another embodiment the electric power can operate a solenoid or a small motor 64 attached to a detent, such as screw 66 in FIG. 8, into the valve member 6' or the extension 53' so that retraction of the detent lets the two move away from passage 20' to open the passage for setting the borehole tool.

Figure 9:
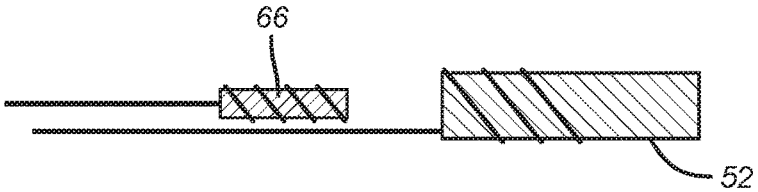
FIG. 9 uses a magnetic field to move the valve member and associated extension.

FIG. 9 shows an energized magnet that repels or attracts the valve member 52' to operate the tool as previously described.

Figure 3:
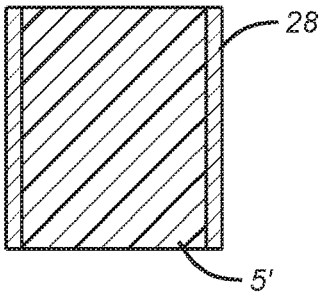
FIG. 3 is a detailed view of a retainer shown in FIG. 2.
Figure 4:
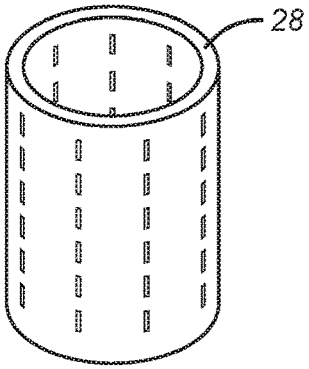
FIG. 4 is a sleeve that can be mounted around the retainer of FIG. 3 to enhance compressive strength until the retainer is remotely undermined.
Figure 5:
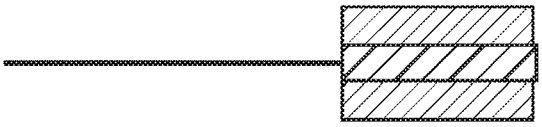
FIG. 5 is a schematic illustration using electric power to break down a binder or melt a surrounding support structure to allow valve member and extension movement to operate the tool.

FIGS. 3 and 4 illustrate a surrounding sleeve 28 bound to or surrounding the restraint 5' to enhance its compressive strength but on disintegration having an inside dimension that is clear of the valve member 6' and its extension 52'.

Those skilled in the art will appreciate that what is described are alternatives to restraint 5 that do not contain the risk inherent in that prior design of the segments not moving perfectly in tandem in unison or getting cocked and jamming the movement of the valve member 6 before the passage 20 can open for setting the borehole tool. The prior design needed radial clearance for segments to move into so that a valve member could have a clear path to move axially in a housing path. The FIG. 2 design alternatives described are operationally more reliable and cheaper to produce. They are actuated with electric power directly or with a heater operated by the electric power source such as a wireline or an electric line or other electrically powered ways. The retaining member abuts a wall that defines as housing passage and its compromise involves weakening in place or transforming size or state or simply forced lateral movement, to name a few options. When that happens the stored potential energy allows the valved port to open and the hydrostatic pressure to operate an actuating piston to set a borehole tool at a desired location. The setting tool described above can be coupled with a formation isolation valve for zone isolation or valves leading out of a string, such as sliding sleeves, and to the formation for performing a treatment in the formation, all of which are schematically represented as arrow 71.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A hydrostatically operated setting tool selectively operated to actuate a borehole tool at a predetermined borehole location, comprising:

a housing comprising a valved port for selective isolation of hydrostatic pressure from an actuating piston in said housing wherein movement of said actuating piston sets the borehole tool;

said valved port further comprising a valve member selectively retained against a potential energy force when said valved port is closed, said valved port selectively opened when a retaining member, initially supported in and abutting a surrounding wall defining a passage in said housing to resist said potential energy force, is compromised in said passage such that said potential energy force is enabled to move said valve member to open said valved port for actuating piston movement that sets the borehole tool; and said retaining member is rotated by an electric motor to translate the retaining member in said passage to release the valve member.

2. A borehole completion method, comprising:

selectively configuring a hydrostatically operated setting tool to actuate a borehole barrier valve or at least one tubular string wall port at a predetermined borehole location;

configuring said setting tool with a housing comprising a valved port for selective isolation of hydrostatic pressure from an actuating piston in said housing wherein movement of said actuating piston sets said barrier valve or said at least one tubular string wall port;

retaining a valve member selectively against a potential energy force when said valved port is closed, said valved port selectively opened when a retaining member, initially supported in and abutting a surrounding wall defining a passage in said housing to resist said potential energy force, is compromised in said passage such that said potential energy force is enabled to move said valve member to open said valved port for actuating piston movement that operates said barrier valve or said at least one tubular string wall port;

said retaining member is rotated by an electric motor to release the valve member for movement; and performing a treatment against said barrier valve or through said at least one tubular string wall port.

3. The method of claim 2, wherein:

performing at least one of hydraulic fracturing, stimulation, tracer injection, cleaning, acidizing, steam injection, water flooding, cementing as said treatment.

* * * * *